US008684214B2

(12) United States Patent
Lim et al.

(10) Patent No.: US 8,684,214 B2
(45) **Date of Patent: *Apr. 1, 2014**

(54) DEGASSING CONTAINER FOR REFRIGERATOR

(75) Inventors: Seok-Min Lim, Changwon (KR); Jong-Min Shin, Changwon (KR); Bong-Jun Choi, Changwon (KR); Su-Won Lee, Changwon (KR); Ill-Shin Kim, Changwon (KR); Jeong-Yon Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 1016 days.

This patent is subject to a terminal disclaimer.

(21) Appl. No.: 12/679,265

(22) PCT Filed: Oct. 22, 2008

(86) PCT No.: PCT/KR2008/006259

§ 371 (c)(1), (2), (4) Date: Mar. 19, 2010

(87) PCT Pub. No.: WO2009/054681

PCT Pub. Date: Apr. 30, 2009

(65) Prior Publication Data

US 2010/0251754 A1 Oct. 7, 2010

(30) Foreign Application Priority Data

Oct. 23, 2007 (KR) ..... 10-2007-0106866

(51) Int. Cl.

| | |
|---|---|
| ***B65D 51/16*** | (2006.01) |
| ***E05C 3/02*** | (2006.01) |
| ***E05C 3/06*** | (2006.01) |
| ***E05B 65/00*** | (2006.01) |
| ***E05C 19/00*** | (2006.01) |
| ***F25D 15/00*** | (2006.01) |

(52) U.S. Cl.

USPC ..... 220/303; 62/331; 137/907; 220/231; 220/366.1; 70/DIG. 48; 277/913; 292/194; 292/195; 292/197; 292/198; 292/256.5; 292/303; 292/DIG. 38; 292/DIG. 63; 292/DIG. 71

(58) Field of Classification Search

USPC ..... 62/100, 268, 169, 455, 331; 137/907; 220/231, 303, 366.1; 70/DIG. 48; 277/913; 292/256.5, 303, DIG. 71, 292/DIG. 38, DIG. 63, 194, 195, 197, 198

See application file for complete search history.

(56) References Cited

U.S. PATENT DOCUMENTS 1,736,173 A * 11/1929 Reid ..... 220/302

(Continued)

FOREIGN PATENT DOCUMENTS

KR 10-2002-0034301 A 5/2002
KR 10-2006-0106350 A 10/2006

*Primary Examiner* — Allen Flanigan
*Assistant Examiner* — Filip Zec
(74) *Attorney, Agent, or Firm* — Birch, Stewart, Kolasch & Birch, LLP

(57) ABSTRACT

Provided is a degassing container for a refrigerator in which a portion of air within a storage space is forcedly discharged to allow the storage space to become a low pressure state. The degassing container includes a case, a door, a gasket, a pressing part, and a degassing adjustment part. The case has an opened side. The door selectively shields the opened side of the case. The gasket is interposed between the door and the case and elastically deformed and closely attached when the door is shielded. The pressing part is provided in the door and the case and selectively closely attaches the door by a rotation operation. The degassing adjustment part selectively enters and exits air within the case by operating the pressing part. Therefore, the refrigerator has improved storage performance.

15 Claims, 4 Drawing Sheets

(56) References Cited

U.S. PATENT DOCUMENTS

| | | | | | |
|---|---|---|---|---|---|
| 2,775,111 | A * | 12/1956 | Savage | 70/9 |
| 2,926,945 | A * | 3/1960 | Clark | 292/332 |
| 5,110,003 | A * | 5/1992 | MacWilliams | 220/304 |
| 5,169,015 | A * | 12/1992 | Burke | 220/203.07 |
| 5,269,431 | A * | 12/1993 | Sakata et al. | 220/203.17 |
| 5,443,175 | A * | 8/1995 | Kelly et al. | 220/298 |
| 5,634,566 | A * | 6/1997 | Jansen et al. | 220/254.8 |
| 5,944,212 | A * | 8/1999 | Chang | 220/212 |
| 5,957,317 | A * | 9/1999 | Lee | 220/212 |
| 6,375,024 | B1 * | 4/2002 | Park | 215/262 |
| 6,626,314 | B1 * | 9/2003 | McHenry et al. | 220/254.2 |
| 6,718,776 | B2 * | 4/2004 | Wessling et al. | 62/60 |
| 6,994,227 | B2 * | 2/2006 | Kwon | 220/212 |
| 7,082,783 | B2 | 8/2006 | Uihlein et al. | |
| 7,325,409 | B2 * | 2/2008 | Espinosa | 62/78 |
| 8,359,879 | B2 * | 1/2013 | Kim et al. | 62/404 |

* cited by examiner

Fig. 3
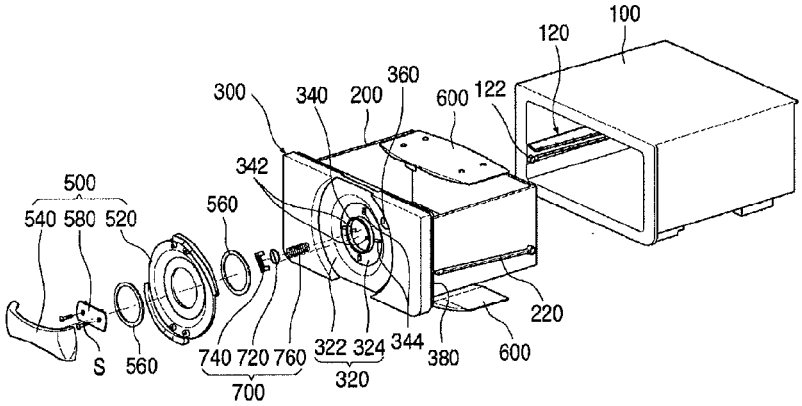
Fig. 4
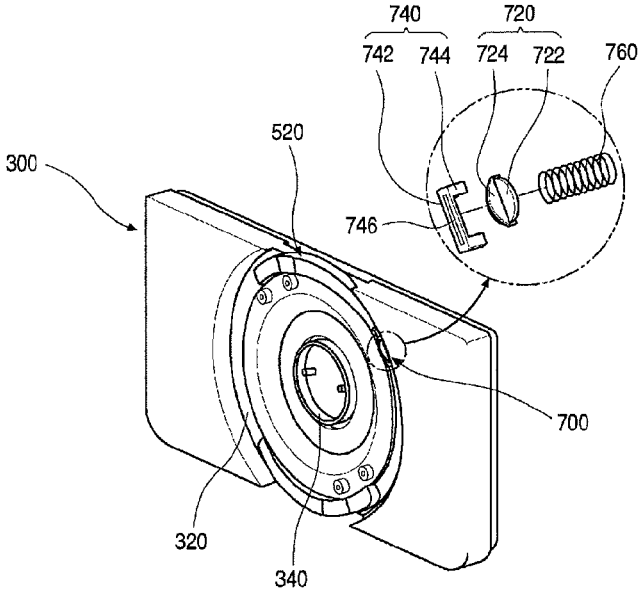
[Fig. 5]
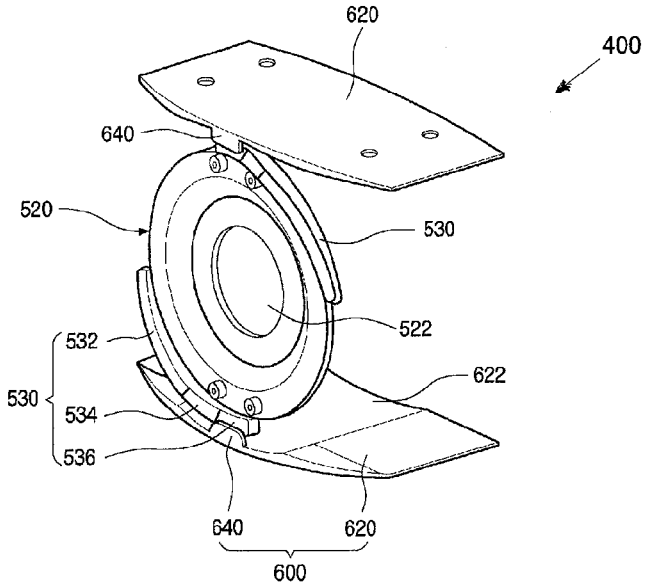

DEGASSING CONTAINER FOR REFRIGERATOR

TECHNICAL FIELD

The present disclosure relates to a degassing container for a refrigerator.

BACKGROUND ART

Refrigerators are domestic appliances that can store foods at a low temperature in a storage space that is shielded by a refrigerator door. For this, the storage space is kept at the low temperature by taking heat from the storage space using a refrigerant so that the foods can be kept fresh in the storage space.

Due to changes in dietary life and well-being trends, consumers prefer larger, multi-functional refrigerators, and various convenient refrigerators have been introduced in the market.

The inside of such a refrigerator is divided by a shelf, a drawer, and a basket, and the foods are stored in each of divided storage spaces. Foods that must be stored separately from the other foods are stored in a storage space such as the drawer in which the foods are stored in a state of sealing or a state similar to the sealing. In general, foods such as vegetables sensitive to a temperature and moisture are stored in the storage space.

For storing the foods such as the vegetables in the storage space for a long time, it is preferable that an amount of air within the storage space is minimized, thereby providing a device for degassing the air within the space.

A refrigerator including the device capable of degassing the air within the storage space is disclosed in Korean Patent Registration Nos. 0547426 and 0606728. The device discharges a portion of the air within the storage space to reduce the amount of air within the storage space, thereby improving storaging performance of the storage space.

However, in the Korean Patent Registration No. 0547426, it is difficult to maintain sealing of a tray and a cover. In addition, since the cover must be vertically movable for an sealing operation of the storage space, a space for the sealing operation must exist in an upper portion of the cover. As a result, a receiving space is reduced.

Since the whole cover must be moved at the same time in order to effectively attach and detach the cover, the operation is not easily performed.

Also, in the Korean Patent Registration No. 0606728, since the air is discharged toward a rear direction that is an insertion direction of a storage container, the air is not smoothly discharged. In addition, for opening the storage container, the storage container must be forcedly opened in order to introduce external air into the storage container. As a result, this reduces the convenience in use.

DISCLOSURE OF INVENTION

Technical Problem

Embodiments provide a degassing container for a refrigerator in which a portion of air within a storage space is forcedly discharged by a pressing part to create a low pressure zone within the storage space.

Embodiments also provide a degassing container for a refrigerator in which air is selectively discharged by rotating a pressing part for closely attaching a door through a degassing adjustment part, and foods are stored in a low pressure state due to elastic deformation of a gasket.

Technical Solution

In one embodiment, a degassing container for a refrigeratoran apparatus includes: a case having an opened side; a door selectively shielding the opened side of the case; a gasket between the door and the case, the gasket being elastically deformed and closely attached when the door is shielded; a pressing part in the door and the case, the pressing part selectively closely attaching the door by a rotation operation; and a degassing adjustment part on a side in contact with the pressing part, the degassing adjustment part being selectively opened and closed according to a rotation of the pressing part to discharge air of a volume corresponding to the deformation of the gasket into the outside of the case.

In another embodiment, a degassing container for a refrigerator includes: a slidingly withdrawable/insertable drawer inside a storage space; a door formed in one body, the door selectively shielding the storage space; a rotor assembly in a side of the door, the rotor assembly opening and closing the door by a rotation operation; a gasket elastically deformed and closely attached to a front end of the storage space when the door is shielded; a guide selectively interfered according to a rotation of the rotor assembly to selectively press the gasket; and a degassing adjustment part selectively opened and closed by the rotation operation of the rotor assembly, the degassing adjustment discharging air inside the storage space when the gasket is pressingly deformed.

In further another embodiment, a degassing container for a refrigerator includes: a door formed in one body, the door selectively shielding a storage space; a rotor assembly in a side of the door, the rotor assembly performing a rotation operation for opening and closing the door; a gasket in the door, a gasket elastically deformed and closely attached to the storage space when the door is shielded; a guide selectively contacting with an inclined portion inclinedly disposed in the rotor assembly when the rotor assembly is rotated; and a degassing adjustment part in the door, the degassing adjustment part selectively opened and closed according to the rotation of the rotor assembly to adjust entrance and exit of air inside the storage space.

Advantageous Effects

In a degassing container for a refrigerator according to present embodiment, a gasket elastically deformed and closely attached to a storage space when a door is closed, and a degassing adjustment part exhaust air inside of a container to the outside. Therefore, the storage performance improves in a container, and user can control simultaneously closing the door and degassing air inside of the container by controlling rotor assembly, thus, industrial applicability is high.

BRIEF DESCRIPTION OF THE DRAWINGS

FIG. 3 is a exploded perspective view of a degassing container for a refrigerator according to an embodiment.

FIG. 4 is a exploded perspective view illustrating a degassing adjustment part of a degassing container for a refrigerator according to an embodiment.

FIG. 5 is a cross-sectional view illustrating a rotor and a guide of a degassing container for a refrigerator according to an embodiment.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

A degassing container for a refrigerator according to the present disclosure may be applied to various types of refrigerators such as a top mount type, a bottom freeze type, and a side by side type.

For further explanation and better comprehension, the side by side type refrigerator will now be described as an example.

Figure 1:
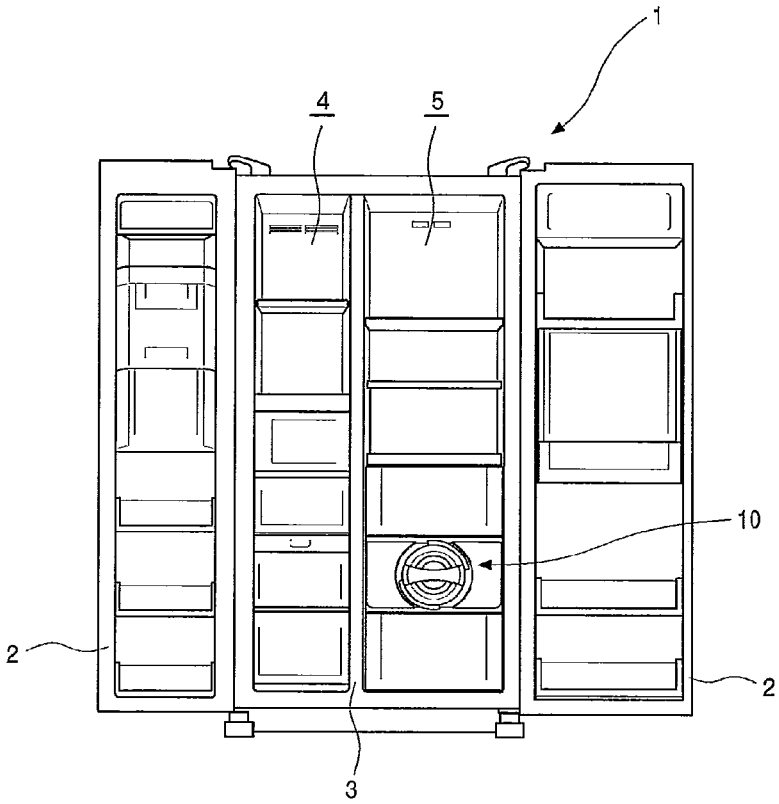
FIG. 1 is a front view of a refrigerator including a degassing container according to an embodiment when a door is opened.

FIG. 1 is a front view of a refrigerator including a degassing container according to an embodiment when a door is opened. Referring to FIG. 1, an appearance of a refrigerator has a rectangular shape and includes a body 1 providing a storage space and a refrigerator door 2 shielding the body 1.

A barrier 3 divides the inside of the body 1 into left and right sides to define a freezer compartment 4 and a refrigerator compartment 5. The freezer compartment 4 and the refrigerator compartment 5 are respectively shielded by the refrigerator door 2 pivotally coupled to the body 1.

Receiving members such as a plurality of shelves, plurality of drawers, and plurality of baskets are disposed inside the freezer compartment 4 and the refrigerator compartment 5 to partition the insides of the freezer compartment 4 and the refrigerator compartment 5. Each drawer may accessibly slide in front and rear directions in the inside of the body 1, and thus be selectively opened and closed.

The drawer provides an independent space inside the freezer compartment 4 or the refrigerator compartment 5 to store foods in a state of a temperature and/or moisture different from those/that of the other foods. For example, the drawer is used as a vegetable room for storing vegetables or fruits, a quick freezing room for quick freezing, and a defrosting room in which a temperature can be adjusted to thaw a meat and fish.

The vegetable room provided in the refrigerator compartment 5 is defined by a degassing container 10 according to the present disclosure. Since foods stored in the vegetable room defined by the degassing container 10 has a relatively short storage life, the vegetable room may become in a state similar to a vacuum state by reducing an amount of air within the vegetable room to store the foods for a further long time as well as in a more fresh state.

Figure 2:
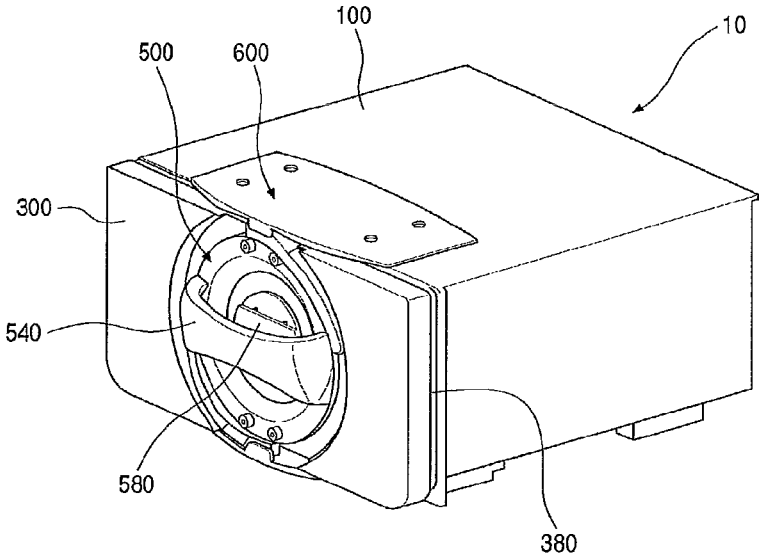
FIG. 2 is a perspective view of a degassing container for a refrigerator according to an embodiment.

FIG. 2 is a perspective view of a degassing container for a refrigerator according to an embodiment, and FIG. 3 is a exploded perspective view of a degassing container for a refrigerator according to an embodiment.

Referring to FIGS. 2 and 3, an appearance of the degassing container 10 is defined by a case 100 providing a storage space and a door 300 selectively opening and closing the storage space.

The case 100 is disposed inside the refrigerator compartment 5. The case 100 has an approximately rectangular shape and provides a space therein. Also, the case 100 is opened in a front direction. The case 100 may be formed of an insulation material such that the case 100 is separated from the refrigerator compartment 5 and dose not have an effect on a temperature. The case 100 may be detachably disposed inside the refrigerator compartment 5.

All surfaces of the case 100 except a front surface thereof are shielded to provide a sealed space in case where the front surface is shielded. As a result, the case 100 provides a separate space inside the refrigerator compartment 5.

The case 100 may be integrated with an inner surface of the body 1 in one body. In this case, the case 100 is defined by an inner case defining an inner surface of the refrigerator compartment 5 and opened in a front direction.

Depending on the user's requirements, the shelf dividing a space of the lowest partition of the refrigerator compartment 5 may be disposed, and a storage space of the degassing container 10 having the same shape as that of the case 100 may be defined in a space between inner lower surfaces of the shelf and the refrigerator compartment 5.

Guide parts 120 are disposed on both inner surfaces of the case 100. The guide parts 120 guides an access of a drawer received into the case 100. The guide parts 120 protrude from the both inner surfaces of the case 100, and each of the guide parts 120 includes at least one or more rollers 122 such that the guides 120 are smoothly slid as compared with a drawer 200 that will be described below.

The door 300 shields the opened front surface of the case 100. The door 300 has an approximately square shape corresponding to that of the front surface of the case 100. The drawer 200 is disposed in a back surface of the door 300. The drawer 200 has a size that can be received inside the case 100.

Guide ribs 220 are disposed on both side surfaces of the drawer 200. The guide ribs 220 are seated on the guide parts 120 of the case 100, respectively. Each of the guide ribs 220 is in contact with each of the rollers 122 to smoothly slide and access the drawer 200.

The door 300 has a rectangular shape corresponding to that of the opened front surface of the case 100 to selectively shield the opened front surface of the case 100. The door 300 including a rotor assembly 500 constituting a pressing part 400 with guides 600 that will be described below, a degassing adjustment part 700, and a gasket 380.

A rotor mounting portion 320 for mounting the rotor assembly 500 that will be described below is disposed in the front surface of the door 300. The rotor mounting portion 320 has a circular shape corresponding to that of a rotor 520 that will be described below. The rotor mounting portion 320 is recessed toward an inner side of the door 300 and has a size greater than that of the rotor 520 to smoothly rotate the rotor 520.

The rotor mounting portion 320 has a first recess portion 322 and a second recess portion 324. The second recess portion 324 is recessed again inside the first recess portion 322 to form a height different having two stages in the front surface of the door 300 as a whole.

The first recess portion 322 disposed outside the second recess portion 324 has a circular shape having a diameter greater than an up-and-down distance of the door 300. An upper portion and a lower portion of the first recess portion 322 are opened toward an upper end and a lower end of the door 300, respectively. An interference between each guide 600 and the rotor 520 that will be described below may occur through the opened portions.

A rotor rotating shaft 340 having a predetermined diameter protrudes from a central portion of the second recess portion 324 disposed inside the first recess portion 322, i.e., a central portion of the rotor mounting portion 320. The rotor rotating shaft 340 is a rotation center of the rotor 520, and may pass through a center of the rotor 520.

Fixing bosses 342 for fixing the rotor 520 are disposed on both inner surfaces of the rotor rotating shaft 340. The fixing bosses 580 are used for mounting a fixing plate 580 that will be described below, and screws S passing through the fixing plate 580 are coupled.

Supporting protrusions 344 disposed in a radial direction protrude from an outer surface spaced from the rotor rotating shaft 340. Rotor rings 560 for smoothly rotating the rotor 520 are seated on the supporting protrusions 344. The supporting protrusions 344 are disposed in up/down/left/right directions, respectively. Preferably, each of the supporting protrusions 344 has a height less than a protrusion height of the rotor rotating shaft 340.

The rotor assembly 500 constituting the pressing part 400 is installed on the rotor mounting portion 320. The rotor assembly 500 is restricted with the guides 600 by an user's operation, and presses such that the door is closely attached to the case 100. Air may selectively flow in and out through the degassing adjustment part 700 according to a rotating operation of the rotor assembly 500.

The rotor assembly 500 includes the rotor 520 and a handle 540. The rotor 520 has a circular plate shape and is rotatably installed on the rotor mounting portion 320. The rotor 520 has a shape corresponding to that of the rotor mounting portion 320 to seat the rotor 520 inside the rotor mounting portion 320. The rotor rotating shaft 340 passes through the rotor 520 to rotate the rotor 520. A detailed explanation of the rotor 520 will be described below.

The rotor rings 560 are disposed on front and rear surfaces of the rotor 520, respectively. Each of the rotor rings 560 has a ring shape having a predetermined width. The rotor rings 560 are closely disposed on the front and rear surfaces of the rotor 520, respectively. The rotor rings 560 are formed of an engineering plastic such as a POM to smoothly rotate the rotor 520. An external diameter of the rotor ring 560 is greater than an internal diameter thereof, thereby preventing the rotor 510 from being separated, and also further smoothly rotating the rotor 510. The rotor ring 560 may be formed of the other materials that can reduce friction.

The fixing plate 580 is disposed at an approximately central portion of the rotor 520. The fixing plate 580 has a diameter slightly greater than that of a through hole 522 of the rotor 520 through which the rotor rotating shaft passes. The fixing plate 580 is in contact with a front surface of the rotor ring 560 disposed on a front surface of the rotor 520. The screws S pass through both sides of the fixing plate 580. The screws S are coupled to the fixing bosses 342 to couple the fixing plate 580 to the door 300.

The rotor 520 is fixed to the rotor mounting portion 320 of the door 300 by the fixing plate 580. The rotor 520 may be easily mounted and smoothly rotated by the rotor rings 560 respectively interposed between the fixing plate 580, the rotor 520, and the door 300.

The handle 540 is installed on the rotor 520. The handle 540 is used for grasping the rotor 520 during the rotating operation of the user. The handle 540 is disposed on the front surface of the rotor 520, and both ends of the handle 540 are coupled to cuter sides of the front surface of the rotor 520 to rotate the rotor 520 by operating the handle 540. In addition, a degree of the rotation of the rotor 520 and a sealed state within the case 110 can be visible through a state of the rotor 520.

The gasket 380 is disposed around the back surface of the door 300. The gasket 380 allows the door 300 and the case 100 to be closely attached to each other when the door 300 is closed to seal the inside of the case 100.

The gasket 380 is formed of a material having predetermined elasticity such as silicon and synthetic resins. When the door 300 is closed, the gasket 380 is pressed by a predetermined distance toward the case 100 to reduce the whole volume of the inside of the case 100.

In detail, the gasket 380 is disposed along the outline of the back surface of the door 300 and extends by a predetermined length in a rear direction to press the door 300 when the door 300 is in contact with a front end of the case 100.

For this, it is preferable that the gasket 380 has a plate shape having a relatively thin thickness and a bend shape having a predetermined curvature in an outside direction. This is done for reason that the gasket 380 is easily elastically deformed to effectively reduce the sealed space defined by the case 100 and the door 300 when an extended end portion of the gasket 380 is in contact with the case 100.

At this time, as the extended length of the gasket 380 becomes longer, a degree of the deformation due to the compression increases to significantly reduce the volume of the sealed space. As a result, the air within the case 100 can be further discharged into the outside.

Alternatively, a typical gasket having a hollowed inside or gaskets having the other shapes, but a plate shape, may be used for the gasket 380. If the press deformation sufficiently occurs by contacting with the case 100, various types of gaskets may be used.

The door 300 must be moved in a rear direction in order to deform the gasket 380. The door 300 is moved by the pressing part 400 in the rear direction. That is, the door 300 is moved in the rear direction due to the rotation of the rotor assembly and interference of the guides 600 to press the gasket 380, thereby deforming the gasket 380.

The guides 600 are disposed on front portions of top and bottom surfaces of the case 100. The pressing part 400 includes the guides 600 and the rotor assembly 500. When the rotor assembly 500 is rotated, each of the guides 600 selectively contacts with a side of the rotor 520 to press such that the door 300 is movable in the front and rear directions.

The guides 600 are fixedly installed on the case 100. A portion of the case 100 selectively interferes according to the rotation operation of the rotor assembly 500 to maintain a state in which the door 300 shields the case 100.

An air vent 360 is defined in a side of the rotor mounting portion 320. The air vent 360 passing through the door 300 is a passage in which air flows into/from the storage space. The air vent 360 is disposed in a side of the first recess portion 322 such that the door 300 is opened in a state of opening. The degassing adjustment part 700 selectively shielding the air vent 360 is disposed at a side of the air vent 360.

FIG. 4 is a exploded perspective view illustrating a degassing adjustment part of a degassing container for a refrigerator according to an embodiment. The degassing adjustment part will be described in detail with reference to FIG. 4. The degassing adjustment part 700 includes a shield member 720, an interference member 740, and elastic member 760.

The shield member 720 selectively shields the air vent 360 disposed in the door 300. The shield member 720 includes a shield portion 722 and a guide portion 724. The shield portion 722 has a circular plate having a diameter greater than a diameter of the air vent 360 and shields the air vent 360. The guide portion 724 protrudes from a central portion of the shield portion 722 in a front direction.

The guide portion 724 cross a center of the shield portion 722. An upper end and a lower end of the guide portion 724 slightly protrude toward the outside of the shield portion 722 and may be guided by the interference member 740 when the guide portion 724 is moved in front and rear directions. A protruded portion of the guide portion 724 perpendicular to a front surface of the shield portion 722 and having a semicircular shape may be inserted into a side of the interference member 740.

The interference member 740 prevents the shield member 720 from being separated during movement of the shield member 720 to allow the shield member 720 to shield the air vent 360 by moving the shield member 720 in front and rear direction. The interference member 740 has a "" ⊏ "" shape in side view and a size receivable the shield member 720.

The interference member 740 includes a horizontal portion 742 extending by a predetermined length and a vertical portion 744 vertically extending from both ends of the horizontal portion 742 and coupled to the door 300 adjacent to the air vent 360.

The horizontal portion 742 has a predetermined width, and a receiving hole 746 having a vertically elongated opening is disposed in a center of the horizontal portion 742. A size of the receiving hole 746 corresponds to a thickness of the guide portion 724 such that the guide portion 724 of the shield member 720 is inserted.

The vertical portion 744 extends up to a distance in which the shield member 720 is movable. Although not shown, a guide groove (not shown) is formed inside the vertical portion 744 to receive the upper and lower ends of the guide portion 724 of the shield member 720. Thus, the shield member 720 is stably movable along the guide groove in front and rear directions. The guide portion 724 enters and exits into/from the receiving hole 746 of the horizontal portion 742 according to the movement of the shield member 720.

The elastic member 760 is disposed between the shield member 720 and the front surface of the door 300. The elastic member 760 provides a elastic force in an outward direction to maintain a state in which the shield member 720 opens the air vent 360. Preferably, a compressing spring is used for the elastic member 760.

The shield member 720 is pushed by the elastic member 760 in an outward direction in a state where an external force is not applied to the shield member 720 to open the air vent 360, thereby allowing an air flow. When the guide portion 724 of the shield member 720 is pressed by the rotor assembly 500, the shield member 720 closes the air vent 360 to prevent the air from flowing.

The degassing adjustment part 700 is installed in a front direction of the air vent 360 and selectively opened and closed due to the rotation of the rotor assembly 500. When the door 300 is opened by operating the rotor assembly 500, the degassing adjustment part 700 must be opened. When the door 300 is closed by operating the rotor assembly 500, the degassing adjustment part 700 must become in a shield state with the opened degassing adjustment part 700.

Thus, a position of the degassing adjustment part 700 must be determined according to a position and a movement direction of a side of the rotor assembly 500 selectively contacting with the degassing adjustment part 700. The degassing adjustment part 700 may be installed in a front direction of the rotation direction of the rotor assembly 500. According to an embodiment, the degassing adjustment part 700 and the air vent 360 are disposed in about two hour direction (when viewing FIG. 4) with respect to the front surface of the door 300, and this installation position may be changed.

FIG. 5 is a cross-sectional view illustrating a rotor and a guide of a degassing container for a refrigerator according to an embodiment.

Figure 6:
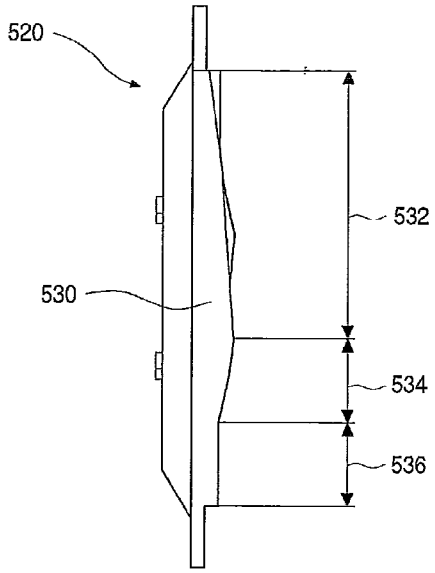
FIG. 6 is a side perspective view illustrating a rotor of a degassing container for a refrigerator according to an embodiment.

FIG. 6 is a side perspective view illustrating a rotor of a degassing container for a refrigerator according to an embodiment.

Configurations of the guides 600 and the rotor 520 will now be described in detail with reference to FIGS. 5 and 6.

Each guide 600 selectively interfere with a side of the rotor 520 to restrict the door 300 and press the door 300 in a close direction. The guide 600 includes guide mounting portions 620 and an interference portion 640.

The guide mounting portions 620 allow the guide 600 to be mounted on the case 100. Each of the guide mounting portion 620 has a plate shape having a predetermined area and is mounted in a state where the guide mounting portion 620 are in contact with a top surface and a bottom surface of the case 100. The guide mounting portions 620 are coupled to the case 100 through a coupling member such as a screw. At this time, front ends of the guide mounting portions 620 slightly protrude than a front end of the case 100, and the door 300 is disposed between the guide mounting portions 620.

A guide recess portion 622 is disposed in a center of an inner surface of the guide 600 in contact with the case 100. The guide recess portion 622 extends from a front end in a rear direction thereof, has a predetermined curvature, and is recessed toward the outside. The guide recess portion 622 receives an outer end of the rotor 520 when the guide 600 is installed. The guide 600 and the side of the rotor 520 are easily interfered from each other through the guide recess portion 622.

The interference portion 640 is disposed at an approximately central portion of the front end of the guide mounting portion 620. The interference portion 640 selectively contacts with the side of the rotor 520, i.e., an inclined portion 530 disposed outside the rotor 520. The interference portion 640 vertically extends from the front end of the guide mounting portion 620 toward the door 300 and has a predetermined width to sufficiently contact with the inclined portion 530.

The rotor 520 is disposed between the guides 600 disposed on upper and lower sides of the case 100. The rotor 520 constituting the rotor assembly 500 is installed on the rotor mounting portion 320 disposed on the door 300. The rotor 520 is interfered with the interference portion 640 of the guide 600 during an operation for shielding the door 300 to press the gasket 380 such that the gasket 380 is pressingly deformed and selectively operates the degassing adjustment part 700 to allow the air within the storage space to selectively flow into/from the storage space, thereby providing a low pressure state inside the case in a state where the door 300 is completely closed.

A configuration of the rotor 520 will not be described in detail with reference to accompanying drawings. The rotor 520 has a circular plate shape and a shape corresponding to the rotor mounting portion 320 such that the rotor 520 is seated in a front direction of the rotor mounting portion 320.

That is, the through hole 522 through which the rotor rotating shaft 340 passes is defined in the approximately central portion of the rotor 520. The inside of the rotor 520 is recessed, and thus, closely attached to the first recess portion 322 and the second recess portion 324.

The inclined portion 530 is disposed on an outer surface of the rotor 520. The inclined portion 530 has a front surface having a predetermined angle. The inclined portion 530 is in contact with the interference portion 640 of the guide 600 to press the door 300 during a rotating movement of the rotor 520. The inclined portion 530 may open and close the degassing adjustment part 700 during the rotating movement of the rotor 520.

In detail, the inclined portion 530 slightly protrudes along the outer surface of the rotor 520 in an outward direction. The inclined portion 530 has a size in which the inclined portion 530 may be exposed through the opened portion of upper and lower ends of the door 300 during the rotation of the rotor 520. The inclined portion 530 having a inclined surface on a front surface thereof is in contact with the interference portion 640 of the guide 600. A rear surface of the inclined portion 530 selectively contacts with the degassing adjustment part 700. A pair of inclined portions 530 is respectively disposed at positions facing each other, preferably, the inclined portions 530 has the same shape.

The inclined portion 530 has a first section 532 and a second section 534. The first section 532 is a starting point at which the inclined portion 530 is in contact with the guide 600 during the rotating operation of the rotor assembly 500. The inclined portion 530 presses and closes the degassing adjustment part 700 during the continuous rotating operation for closing the door 300. The first section 532 is inclined downwardly at an end (a right end when viewing FIG. 5) of the inclined portion 530 and extends up to a predetermined height. According to an embodiment, a height from the starting point of the first section to the highest point is about 10 mm.

Thus, when the rotor 520 is rotated due to the rotation of the rotor assembly 500, the interference portion 640 of the guide 600 contacts along the first section 532 of the inclined portion 530. Since the first section 532 is inclined upwardly, the door receives a pressure toward the case 100 and is pressed to deform the gasket 380.

An extended length of the first section 532 is determined according to a position of the degassing adjustment part 700. That is, it is preferable that the extended length of the first section 532 has a length in which a front end portion of the rear surface of the inclined portion 530 presses the shield member 720 of the degassing adjustment part 700 to close the degassing adjustment part 700.

A second section 534 is defined from the highest point of the first section 532 to the other end portion of the inclined portion 530. The second section 534 is inclined downwardly, i.e., in a direction opposite to the inclined direction of the first section 532. According to an embodiment, a height difference from the highest point of the second section 534 to the lowest point of the second section 534 is about 5 mm.

According to the rotation of the rotor assembly, the interference portion 640 of the guide 600 is moved along the downwardly inclined surface of the second section 534. Thus, the pressure applied to the door 300 is slightly reduced. Therefore, the deformed gasket 380 is restored to allow the inside of the storage space to become a low pressure state.

An extension section 536 horizontally extending by a predetermined length may be further defined at an ending point at which the inclined surface of the second section 534 is ended. The guide 600 is moved along the extension section 356 during the continuous rotating operation of the rotor assembly 500, and thus, the extension section 536 maintains the pressure applied to the door 300. Thus, the door gasket 380 is not restored any longer to maintain the low pressure state inside the storage space.

Figure 7:
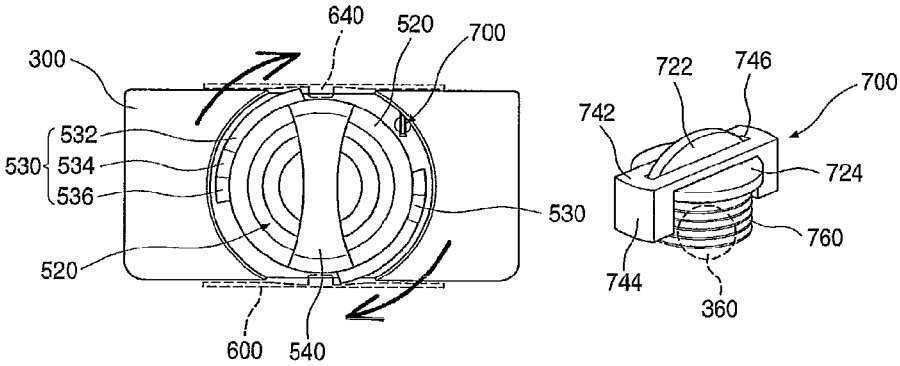
FIG. 7 is a perspective view illustrating a degassing adjustment part of a degassing container for a refrigerator when the degassing adjustment part is closed according to an embodiment.
Figure 8:
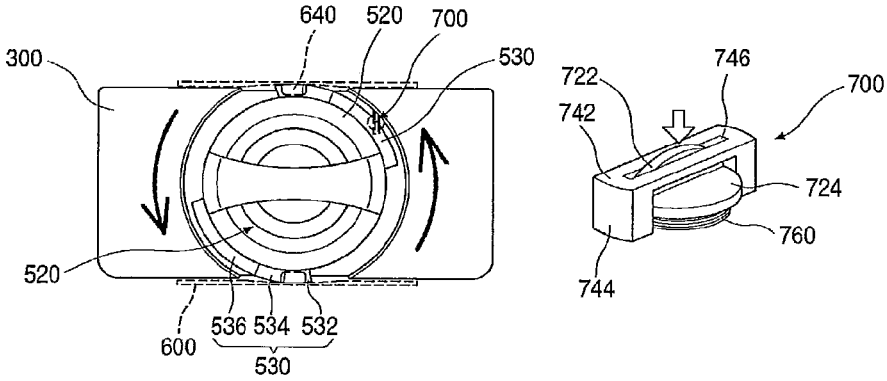
FIG. 8 is a perspective view illustrating a degassing adjustment part of a degassing container for a refrigerator according to an embodiment when the degassing adjustment part is opened.
Figure 9:
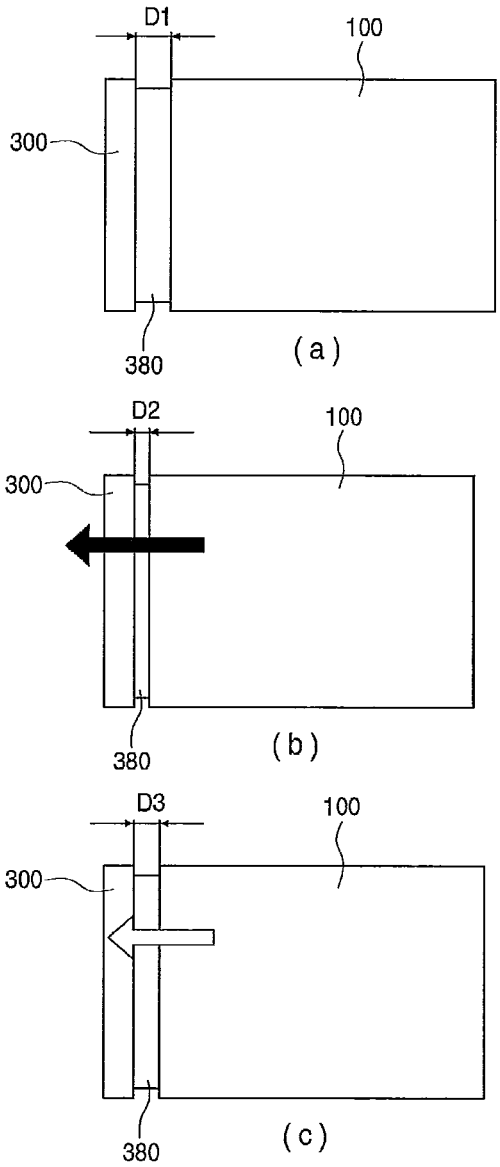
FIG. 9 is a schematic view illustrating a state of a gasket according to an operation of a degassing container for a refrigerator according to an embodiment.

FIG. 7 is a perspective view illustrating a degassing adjustment part of a degassing container for a refrigerator when the degassing adjustment part is closed according to an embodiment, and FIG. 8 is a perspective view illustrating a degassing adjustment part of a degassing container for a refrigerator according to an embodiment when the degassing adjustment part is opened. FIG. 9 is a schematic view illustrating a state of a gasket according to an operation of a degassing container for a refrigerator according to an embodiment.

The operation of the degassing container 10 of the refrigerator having the above configuration will now be described with reference to the accompanying drawings.

The degassing container 10 is provided to the refrigerator compartment and is closed, as illustrated in FIG. 1. For a user to store foods, the door 300 of the degassing container 10 is opened and withdrawn forward, then the foods are put in the drawer 200, and then the door 300 is inserted again.

After inserting the door 300, an inner space of the case 100 is required to be sealed. A state just before the door 300 is sealed, is illustrated in FIG. 7.

That is, in a state where the door 300 is opened with the inner space of the case 100 unsealed, the handle 540 of the rotor assembly 500 is vertically disposed. At this point, since the inclined portions 530 provided to the both sides of the rotor 520 do not reach the interference portions 640, the interference portions 640 do not interfere with the rotor 520, so that the door 300 and the drawer 200 are freely withdrawn and inserted.

A side of the rotor mounting portion 320 of the door 300, and more particularly, the degassing adjustment part 700 disposed in an approximately 2 oblock direction is opened. In this state, the elastic member 760 has pushed the shield member 720 of the degassing adjustment part 700 forward, so that the air vent 360 is opened.

When the door 300 is closed without an exerted external force, the gasket 380 interposed between the door 300 and the case 100 seals the inner space of the door 300 and the case 100.

After storing foods in the drawer 200 of the degassing container 10, the inner space of the case 100 is required to be more completely sealed. To this end, a user grips and rotates the handle 540 clockwise.

Through the rotating of the handle 540, the rotor 520 integrally formed with the handle 540 rotates clockwise. At this point, through the clockwise rotation of the rotor 520, the inclined portions 530 of the rotor 520 move to the guide 600, and through a continuous rotating operation, the interference portions 640 are relatively moved along the first section 532.

At this point, since the first section 532 of the inclined portions 530 is inclined upward, as the rotor 520 rotates, the door 300 is pressed toward the case 100. Accordingly, the gasket 380 interposed between the door 300 and the case 100 is pressingly deformed.

Thus, in comparison with a state where an additional external pressure is not applied to the gasket 380, when the gasket 380 is pressingly deformed, an inner volume defined by the door 300 and the case 100 is decreased by the pressed amount of the gasket 380. As the volume is decreased, air in the case 100 is discharged to the outside through the degassing adjustment part 700.

As the handle 540 is continuously rotated, the interference portions 640 are disposed at boundaries between the first section 532 and the second section 534, i.e., peaks of the inclined portions 530, and simultaneously, a bottom surface of a front end of the inclined portion 530 presses the shield member 720 of the degassing adjustment part 700 to close the degassing adjustment part 700, thereby preventing air from flowing.

In this state, when the handle 540 is further rotated clockwise to completely close the door 300, the handle 540 is horizontally disposed as illustrated in FIG. 8, and the interference portions 640 are disposed at ends of the second section 534.

More particularly, when the handle 540 is continuously rotated clockwise from the point when the interference portions 640 of the guides 600 contact with the second section 534, the interference portions 640 are moved along downward-inclined portions of the second section 534.

Thus, pressure, exerted on the door 300 by the inclined portions 530 and the interference portions 640, is gradually reduced, and at ends of the inclined portions of the second section 534, the gasket 380 is restored by a variation in the height of the second section 534 or by a distance corresponding thereto.

As the gasket 380 is restored, the volume defined by the door 300 and the case 100 becomes greater than the previous one, and the degassing adjustment part 700 is continuously closed by a bottom surface of the inclined portion 530, and thus a storage space in the case 100 is in a low pressure state less than the atmospheric pressure.

In this state, sealing performance of the door 300 is improved, and the door 300 is prevented from being easily opened. Also, as a great portion of air in the case 100 is discharged to the outside, the amount of oxygen causing oxidation and decay of foods is greatly reduced against the volume thereof, so that the foods are efficiently stored, and moisture present in the case 100 is also discharged together with air discharged when the gasket 380 is compressed, to reduce an inner humidity, thereby further efficiently storing the foods.

When the handle 540 is further rotated to be disposed in a complete horizontal direction, the interference portions 640 of the guides 600 are moved along the extension sections 536 of the inclined portions 530, but there is no variation in height, so that there is no variation in pressure exerted on the door 300, and there is no change in the gasket 380.

Also, as the bottom surfaces of the inclined portions 530 press the shield member 720 to continuously maintain the degassing adjustment part 700 at the closed state, the shield member 720 compresses the elastic member 760 to close the air vent 360.

Also, when the door 300 is completely closed, the inclined portions 530 and the interference portions 640 interfere with each other so as to prevent unexpected opening and closing of the door 300.

To open the door 300 again in the state where the door 300 is completely closed, the handle 540 is gripped and rotated in a reverse direction, i.e., counter clockwise, so that the door 300 is opened.

A process, where the rotor assembly 500 is rotated in the reverse direction, is reverse to the above described process, and when the handle 540 is rotated till reaching the state as illustrated in FIG. 7, the interference between the rotor 520 and the guides 600 is removed, and the degassing adjustment part 700 is opened, so that the case 100 is in the atmospheric pressure so as to be opened easily.

INDUSTRIAL APPLICABILITY

According to the embodiments, through the operation of rotating the rotor assembly, the storage space is opened and closed, and simultaneously the gasket is elastically deformed, to discharge air in the storage space. Also, foods are efficiently stored by discharging the air in the storage space, and thus this makes it possible to improve convenience in use and storing performance.

The invention claimed is:

1. A degassing container for a refrigerator comprising:
- a case having an opened side;
- a door selectively shielding the opened side of the case;
- a gasket between the door and the case, the gasket being elastically deformed and closely attached when the door is shielded;
- a pressing part in the door and the case, the pressing part selectively closely attaching the door by a rotation operation; and
- a degassing adjustment part selectively in contact with the pressing part, the degassing adjustment part being selectively opened and closed according to a rotation of the pressing part to discharge air of a volume corresponding to the deformation of the gasket into the outside of the case, wherein the degassing adjustment part comprises:
- a shield member interfering with a side of the rotor assembly, the shield member selectively shielding an air vent passing through the door;
- an interference member restricting a movement of the shield member; and
- an elastic member between the shield member and the door, the elastic member configured to bias the shield member into engagement with the interference member.

2. The degassing container according to claim 1, wherein the pressing part comprises:
- a rotor assembly in the door, the rotor assembly operating the degassing adjustment part by the rotation operation; and
- a guide in the case, the guide selectively contacting with the rotor assembly to restrict and press the door.

3. The degassing container according to claim 2, wherein the rotor assembly comprises:
- a rotor having a circular plate shape, the rotor being rotatably disposed on the door; and
- a handle operating a rotation of the rotor.

4. The degassing container according to claim 3, wherein the rotor further comprises an inclined portion inclinedly disposed along at least a portion of an outer surface of the rotor and selectively contacting with the guide,
- wherein a rear surface of the inclined portion is configured to press the degassing adjustment part while rotating for degassing.

5. The degassing container according to claim 4, wherein the inclined portion comprises:
- a first section inclinedly disposed to press the door; and
- a second section inclinedly disposed in a direction facing the first section.

6. The degassing container according to claim 1, wherein the gasket has a rib shape and is bent in an outer direction during contacting.

7. The degassing container according to claim 1, wherein the gasket has a hollowed inside and is compressed during contacting.

8. The degassing container according to claim 1, further comprising a drawer disposed in a back surface of the door, the drawer receiving foods.

9. The degassing container according to claim 5, wherein the gasket is compressed when the guide is in contact with the first section, and the gasket is restored when the guide is in contact with the second section.

10. A degassing container for a refrigerator comprising:

a slidingly withdrawable/insertable drawer;

a door formed in one body with the drawer, the door selectively shielding a storage space;

a rotor assembly in a side of the door, the rotor assembly opening and closing the door by a rotation operation;

a gasket elastically deformed and closely attached to a front end of the storage space when the door is shielded;

a guide selectively interfered according to a rotation of the rotor assembly to selectively press the gasket; and a degassing adjustment part selectively opened and closed by the rotation operation of the rotor assembly, the degassing adjustment discharging air inside the storage space when the gasket is pressingly deformed, wherein the degassing adjustment part comprises:

a shield member selectively shielding an air vent in which the door is punched;

an interference member to prevent the shield member from being separated; and an elastic member in the door, the elastic member configured to bias the shield member into engagement with the interference member.

11. The degassing container according to claim 10, wherein the rotor assembly comprises:

a rotor having a circular plate shape, the rotor being rotatably disposed on the door; and an inclined portion inclinedly disposed along an outer surface of the rotor and selectively contacting with the guide and the degassing adjustment part during a rotation operation.

12. The degassing container according to claim 11, wherein the inclined portion comprises:

a first section disposed inclinedly from an end, the first section in contact with the guide to gradually press the gasket; and a second section inclinedly disposed in a direction facing the first section at the first section, the second section releasing a compressive force of the gasket;

wherein the degassing adjustment part is opened when the guide is in contact with the first section and is shielded when the guide is in contact with the second section.

13. The degassing container according to claim 12, wherein the degassing adjustment part contacts along a back surface from the first section to the second section of the inclined portion and is shielded.

14. The degassing container according to claim 10, wherein the gasket is disposed around a back surface of the door and has a curvature in an outer direction from the back surface.

15. A degassing container for a refrigerator comprising:

a case having a storage space;

a door selectively opening or closing the storage space of the case;

a container mounted behind the door and received in the storage space when the door is closed;

a gasket between the door and the case, the gasket being elastically deformed and closely attached when the door is shielded;

a pressing part disposed at the door and the case, the pressing part including:

a pressing portion decreasing a gap between a rear surface of the door and a front surface of the case; and a restoring portion increasing the gap between the rear surface of the door and the front surface of the case; and a degassing adjustment part on a side in contact with the pressing part, the degassing adjustment part including:

a shield member selectively shielding an air vent passing through the door;

an interference member restricting a movement of the shield member; and an elastic member between the shield member and the door, the elastic member configured to bias the shield member into engagement with the interference member, wherein the shield member is configured to open the air vent to discharge air in the storage space when the gap decreases, and is configured to shield the air vent when the gap increases, such that the storage space in the case is in a low pressure state less than the atmospheric pressure.

* * * * *